US010983474B1

(12) United States Patent
Li

(10) Patent No.: US 10,983,474 B1
(45) Date of Patent: Apr. 20, 2021

(54) WASTE TONER DETECTION DEVICE

(71) Applicant: GENERAL PLASTIC INDUSTRIAL CO., LTD., Taichung (TW)

(72) Inventor: Kuan-Tung Li, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 16/811,839

(22) Filed: Mar. 6, 2020

(51) Int. Cl.
*G03G 21/12* (2006.01)
*G03G 15/08* (2006.01)

(52) U.S. Cl.
CPC ..... *G03G 21/12* (2013.01); *G03G 15/0856* (2013.01)

(58) Field of Classification Search
CPC ..... G03G 15/0856; G03G 15/087; G03G 21/105; G03G 21/12; G03G 21/1647; G03G 2221/1654
USPC ..... 399/9, 34, 110, 111, 119, 360
See application file for complete search history.

(56) References Cited

U.S. PATENT DOCUMENTS 9,817,359 B2 * 11/2017 Kadowaki ..... G03G 21/12

* cited by examiner

*Primary Examiner* — Hoan H Tran
(74) *Attorney, Agent, or Firm* — Muncy, Geissler, Olds & Lowe, P.C.

(57) ABSTRACT

A waste toner detection device includes a stirring shaft for stirring waste toners, a transmission member moveable in response to a rotational load of the stirring shaft between an engaged position and a disengaged position where the transmission member does not transmit rotation to the stirring shaft, a rotary arm drivenable by the transmission member when the transmission member is located at the disengaged position, and an indication member. The indication member is restricted by the rotary arm at a retracted position when the rotary arm is located at a locked position, and the indication member is driven by a biasing force to move to an extended position when the rotary arm is located at a released position. As a result, the waste toner detection device can accurately detects whether the amount of the waste toners stored in a waste toner container has reached a predetermined amount.

14 Claims, 11 Drawing Sheets

WASTE TONER DETECTION DEVICE

BACKGROUND OF THE INVENTION

1. Field of the Invention

The present invention relates generally to an electronic image-forming apparatus and more particularly, to a waste toner detection device for being used in a waste toner container of an electronic image-forming apparatus.

2. Description of the Related Art

A conventional electronic image-forming apparatus, such as photocopier or printer, is internally equipped with a replaceable waste toner container for collecting waste toners that are not transferred onto paper sheets. When the waste toner container under use is full of toners, user may replace the waste toner container under used with a new one. However, if the waste toner container, which is full of toners, is still used in the electronic image-forming apparatus, the printing quality may deteriorate due to leak of the waste toners. If a waste toner container under use is replaced by a new one in the condition that the waste toner container still has room for storing waste toners, this is a waste of money. Therefore, how to accurately detect whether the amount of the storage toners contained in the waste toner container reaches a predetermined level that a replacement of a new waste toner container shall be taken by a user is an issue that the manufacturers in this industry field need to solve.

SUMMARY OF THE INVENTION

The present invention has bees accomplished in view of the above-noted circumstances. It is an objective of the present invention to provide a waste toner detection device, which can accurately detect whether an amount of the waste toners stored in a waste toner container reaches a predetermined level.

To attain the above objective, the present invention provides a waste toner detection device comprising a stirring shaft for stirring waste toners, a transmission member, a rotary arm, and an indication member. The transmission member is moveable in response to a rotational load of the stirring shaft along as axial direction of the stirring shaft between an engaged position and a disengaged position in a way that the transmission member transmits a rotational motion to the stirring shaft when the transmission member is located at the engaged position, and the transmission member does not transmit the rotational motion to the stirring shaft when the transmission member is located at the disengaged position. The transmission member has a push portion. The rotary arm is driven by the push portion of the transmission member to rotate from a locked position to a released position when the transmission member is located at the disengaged position. The indication member is moveable by a biasing force from a retracted position to an extended position in a way that the indication member is restricted by the rotary arm to maintain at the retracted position when the rotary arm is located at the locked position, and the indication member is driven by the biasing force to move from the retracted position to the extended position without being restricted by the rotary arm when the rotary arm is located at the released position.

By means of the above-mentioned structural features, the waste toner detection device can accurately detect whether an amount of the waste toners stored in a waster toner container reaches a predetermined level.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
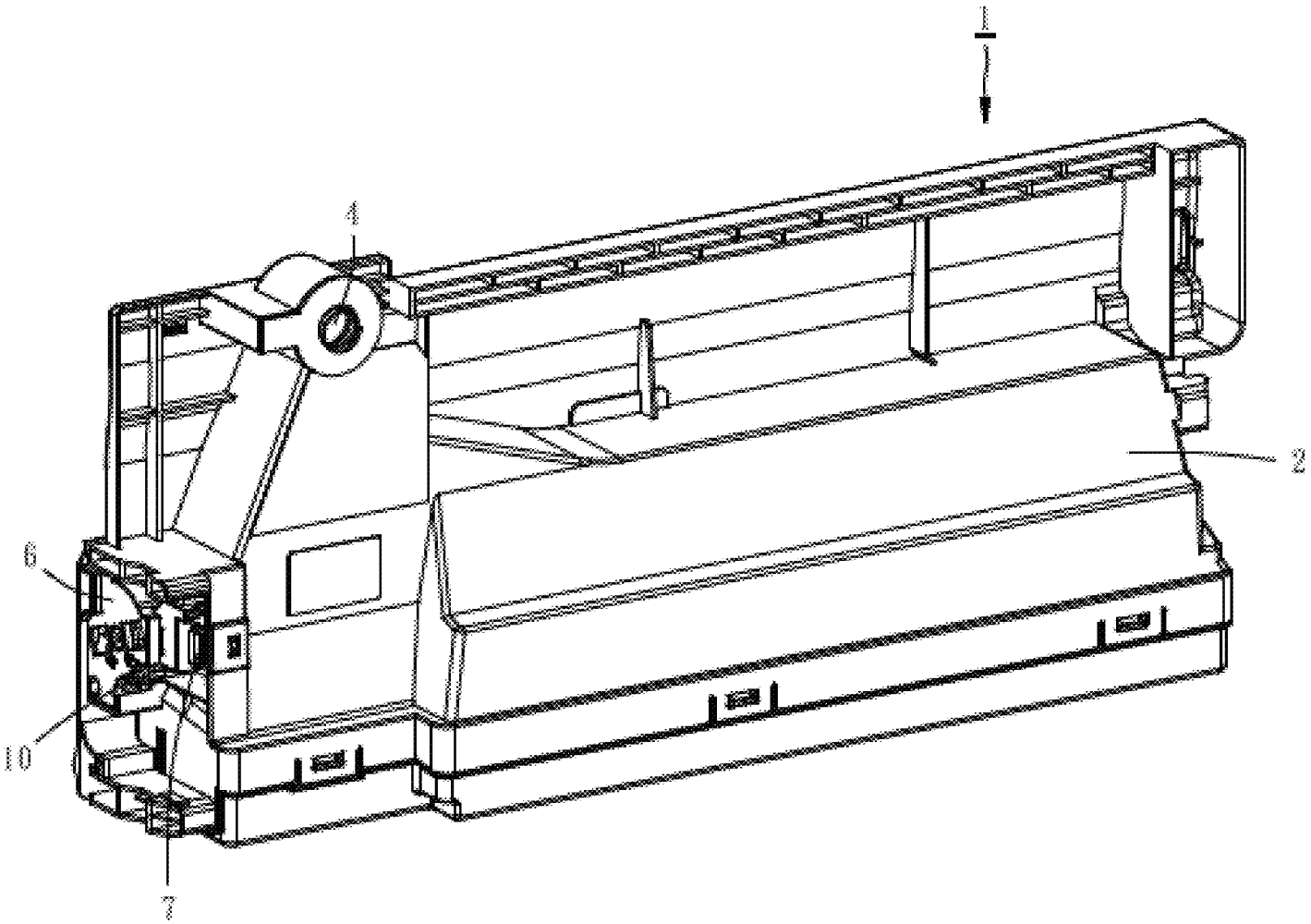
FIG. 1 is a perspective view of a waste toner container according to a preferred embodiment of the present invention.
Figure 2:
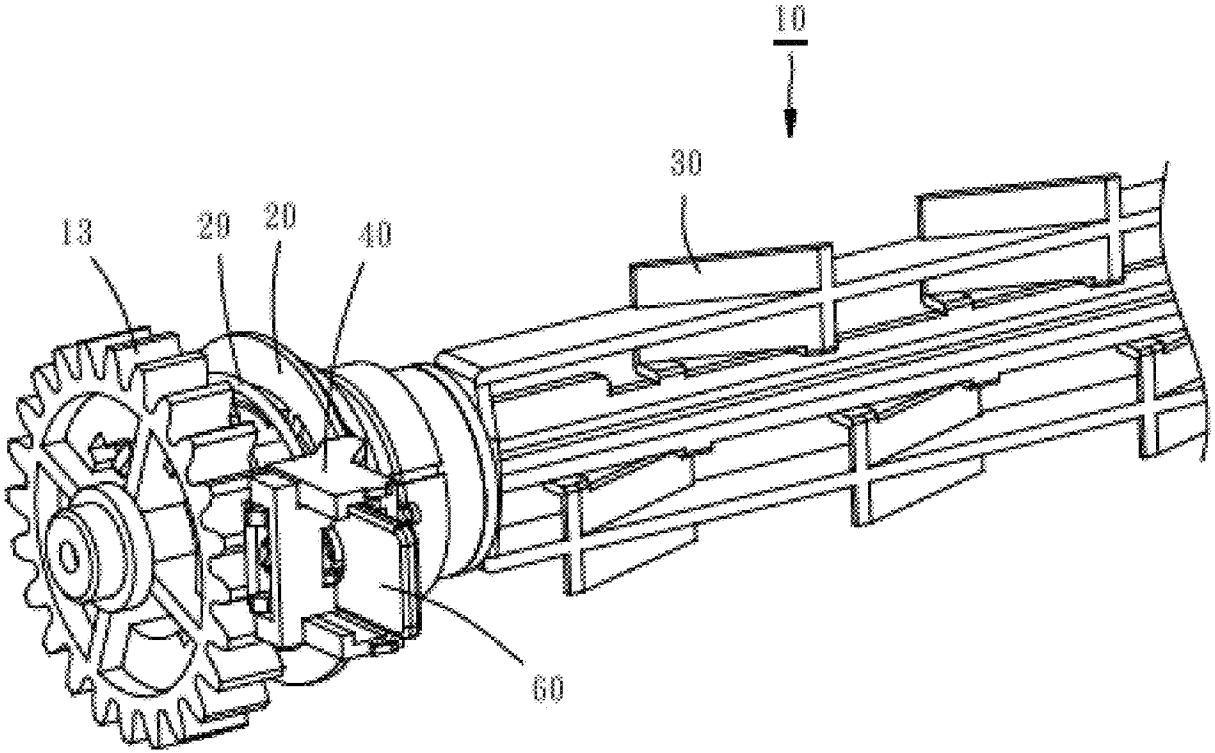
FIG. 2 is a perspective view of a waste toner detection device of the waste toner container according to thee preferred embodiment of the present invention.
Figure 3:
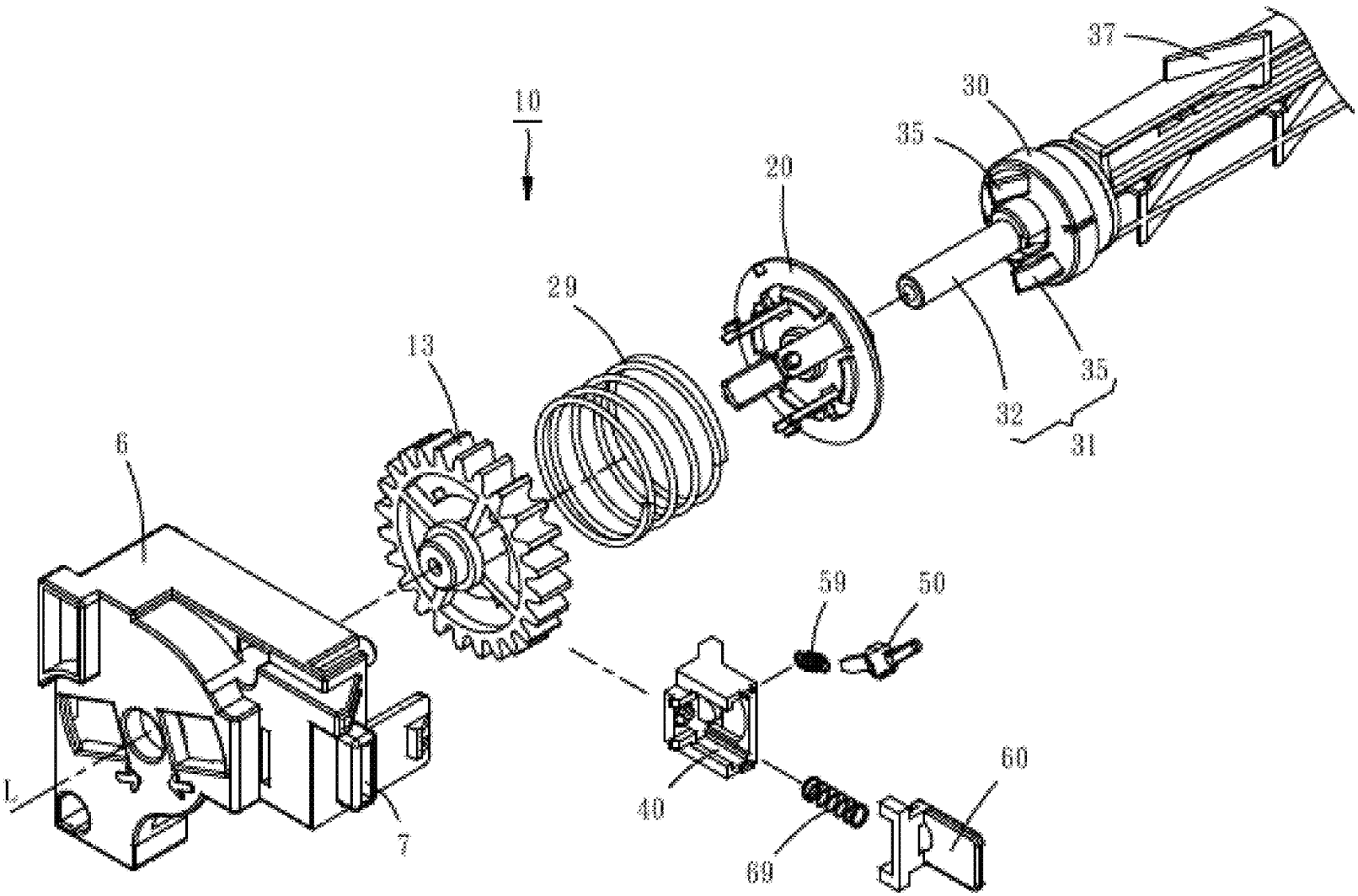
FIG. 3 is an exploded perspective view of a part of the waste toner container of the preferred embodiment of the present invention.

Hereunder one embodiment will be detailedly described with accompanying drawings for illustrating technical features and structure of the present invention. FIG. 1 is a perspective view showing that a waste toner container 1 is equipped with a waste toner detection device 10 in accordance with a preferred embodiment of the present invention. The waste toner container 1 is adapted to be installed in an electronic image-forming apparatus (not shown), such as photocopies, printer, etc. The electronic image-forming apparatus comprises a power source (not shown), and a sensor (not shown). The waste toner container 1 is composed of a housing 2 provided at a top thereof with an entrance 4, and a lateral cover 6 mounted to a side of the housing 2. The lateral cover 6 has an opening 7. The waste toner detection device 10 is mainly disposed in between the housing 2 and the lateral cover 6. The entrance 4 allows redundant waste toners to enter the waste toner container 1 of the image-forming apparatus. The sensor is configured to detect activity of the waste toner detection device 10. As shown in FIGS. 2 and 3, the waste toner detection device 10 is composed of a gear wheel 13, a transmission member 20, a first resilient member 29, a stirring shaft 30, a fixation base 40, a rotary arm 50, a second resilient member 59, an indication member 60, and a third resilient member 69.

Figure 4B:
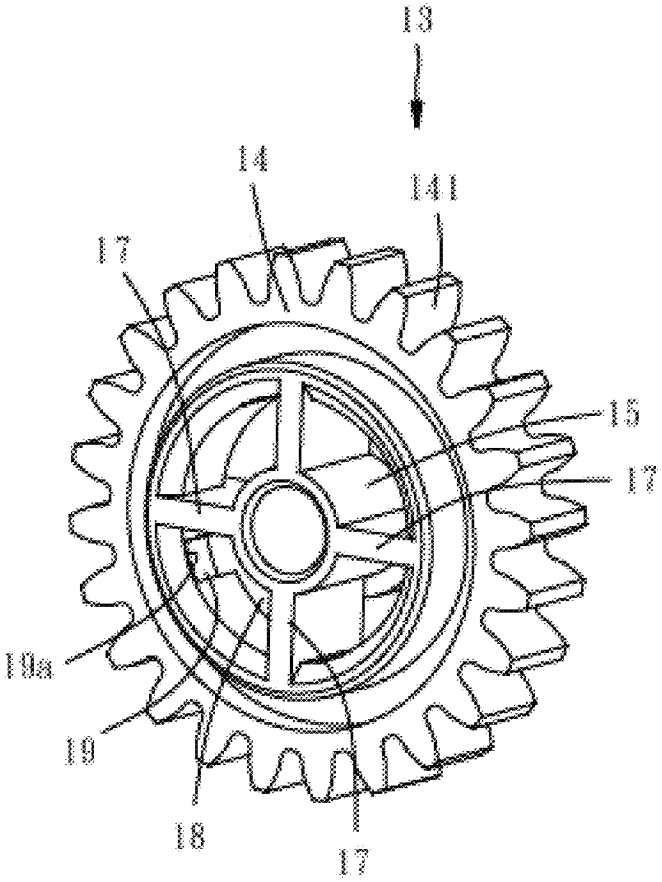
FIG. 4B is another perspective view of the gear wheel of the toner detection device of the preferred embodiment of the present invention.
Figure 4A:
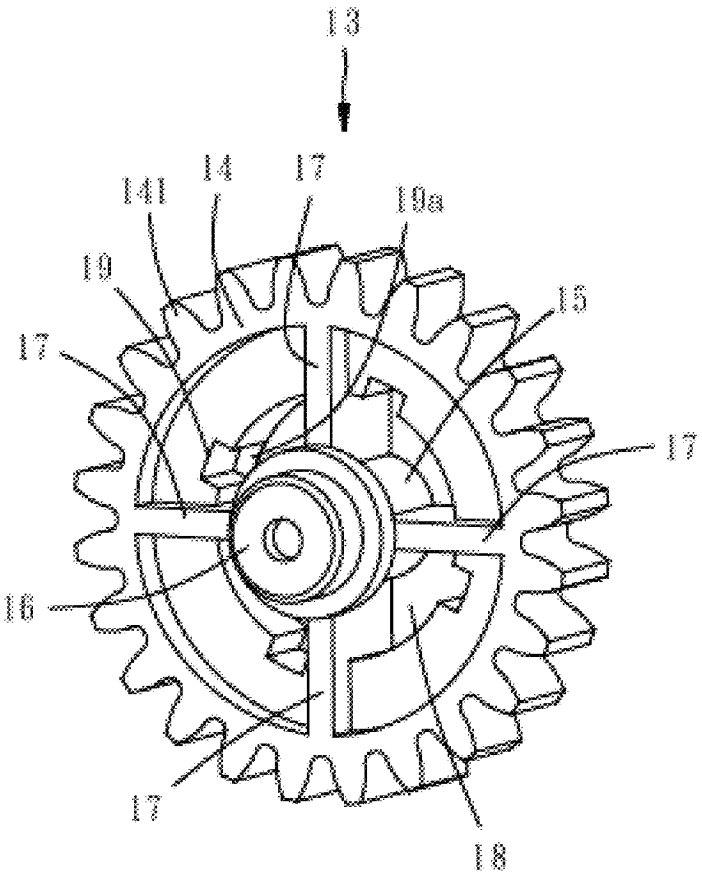
FIG. 4A is a perspective view of a gear wheel of the waste toner detection device of the preferred embodiment of the present invention.

As shown in FIGS. 2 and 3, the gear wheel 13 is rotatably installed to the lateral cover 6 and connected with the above-mentioned power source in such a way that the gear wheel 13 can be driven by the power source to rotate about an imaginary axis L relative to the housing 2. In the preferred embodiment, as shown in FIGS. 4A and 4B, the gear wheel 13 comprises an annular main body 14, a tube portion 15 located at a center of the main body 14 and parallel to the imaginary axis L, a bottom portion 16 provided at an end of the tube portion 15 that is remote from the transmission member 20, four stop walls 17 extending radially from the tube portion 15 to the main body 14, four hollow portions 18 each located between two adjacent stop walls 17, and four axial sliding grooves 19 provided at an inner periphery of the main body 14. The outer periphery of the main body 14 is provided with a tooth portion 141 adapted to receive power transmitted from the power source. Each axial sliding groove 19 extends along a direction parallel to the imaginary axis L and has a stop portion 19*a* adjacent to the transmission member 30.

Figure 5B:
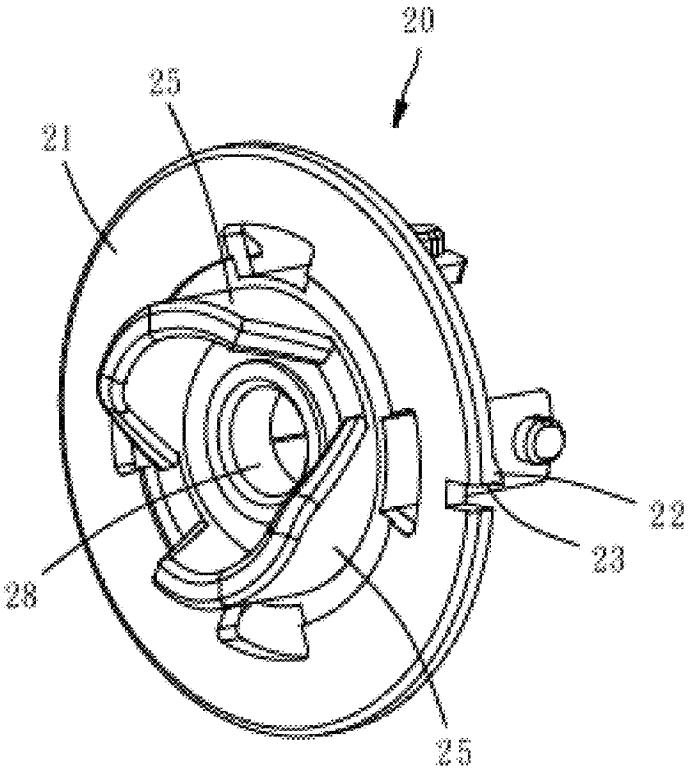
FIG. 5B is another perspective view of the transmission member of the waste toner detection device of the preferred embodiment of the present invention.
Figure 5A:
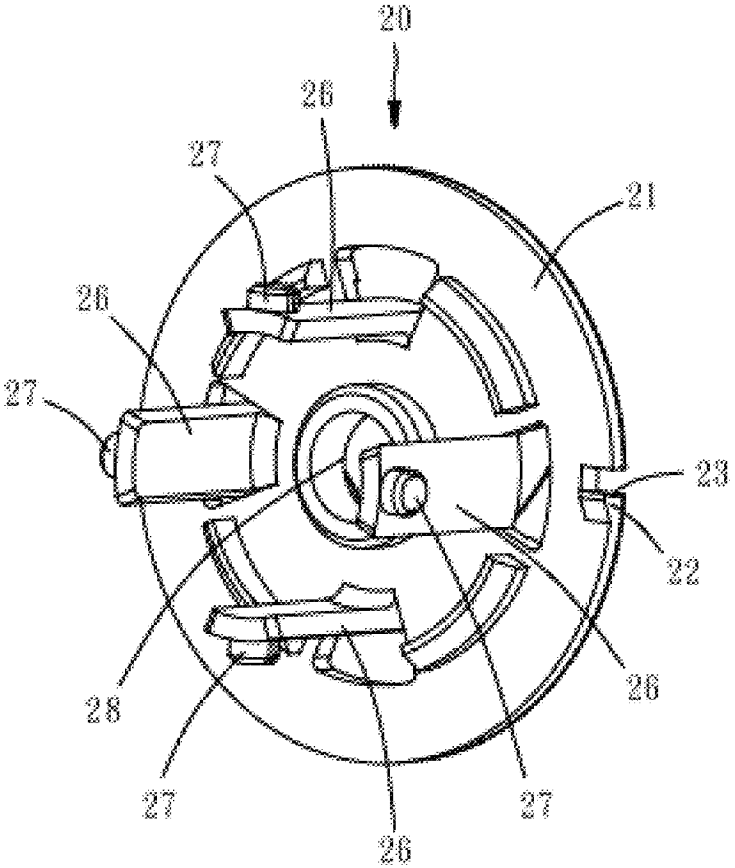
FIG. 5A is a perspective view of a transmission member of the waste toner detection device of the preferred embodiment of the present invention.
Figure 9A:
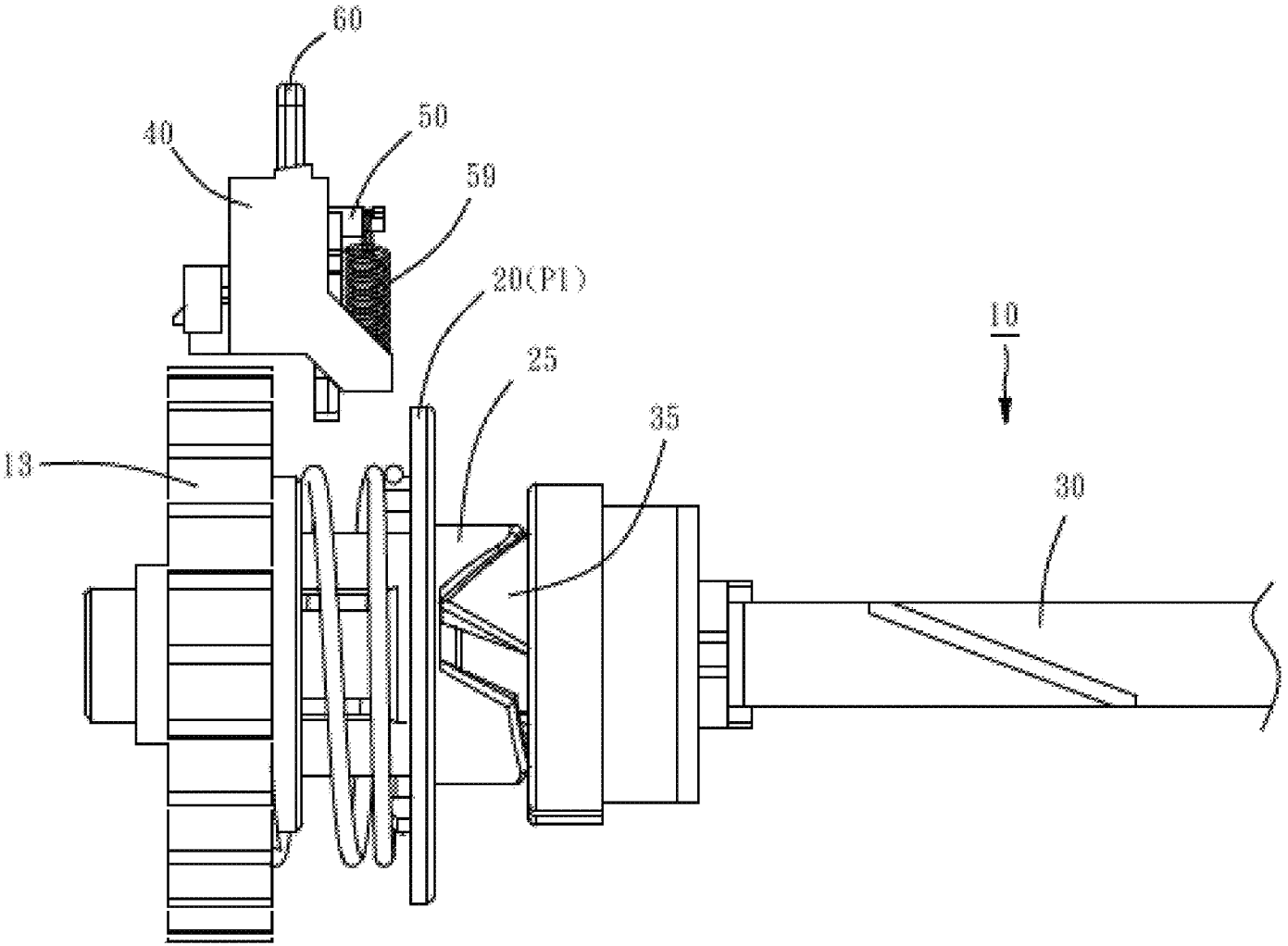
FIG. 9A is a schematic view showing the transmission member of the waste toner detection device is located at an engaged position.
Figure 9B:
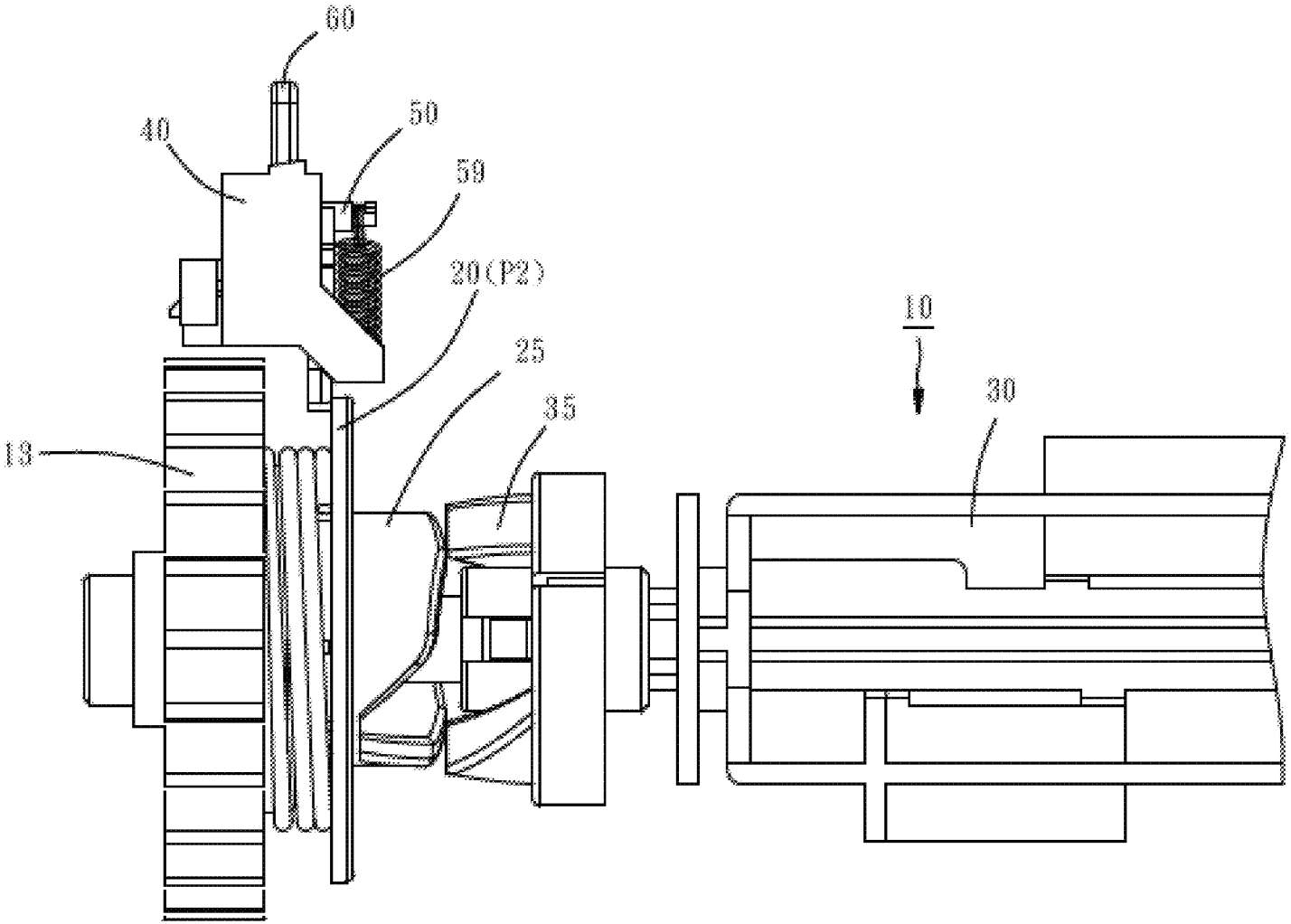
FIG. 9B is a schematic view showing the transmission member of the waste toner detection device is located at a disengaged position.

The transmission member 20 is moveable along the imaginary axis L between an engaged position P1, as shown in FIG. 9A, and a disengaged position P2, as shown in FIG. 9B. As shown in FIGS. 5A and 5B, the transmission member 20 includes a circular disc body 21, a push portion 22 extending from an outer periphery of the disc body 21 toward the gear wheel 13, two engagement portions 25 extending from the disc body 21 toward a direction remote from the gear wheel 13, four arms 26 extending from the disc body 21 toward the gear wheel 13, four protrusion blocks 27, each of which protrudes outwardly and radially from a terminal of one of the four arms 26, and a through hole 28 penetrating through the disc body 21 along the imaginary axis L. The push portion 22 has a first inclined hook surface 23. An included angle of about 10 degrees is defined between the first inclined hook surface 23 and the imaginary axis L. The four arms 26 are inserted into the hollow portions 18, respectively, in such a way that each protrusion block 27 is inserted into one of the axial sliding grooves 19. As such, the transmission member 20 is synchronously and coaxially rotatable with the gear wheel 13. The stop portions 19*a* of the gear wheel 13 can prevent the protrusion blocks 27 from escape from the axial sliding grooves 19 along a direction away from the gear wheel 13.

The first resilient member 29 is realized in this embodiment as a cylindrical coil spring having two ends abutted against the main body 14 of the gear wheel 13 and the disc body 21 of the transmission member 20. The first resident member 29 is configured to impart a biasing force exerting on the transmission member 20 toward the engaged position P1.

The stirring shaft 30 is inserted into the housing 2 and extends along the imaginary axis L for stirring the waste toners. That is, the stirring shaft 30 has an axial direction coaxial with the imaginary axis L. A connecting member 31 is disposed at an end of the stirring shaft 30. The connecting member 31 is connected with the stirring shaft 30, such that the connecting member 31 and the stirring shaft 30 can rotate synchronously. The connecting member 31 has an axle 32 and two protrusion blocks 35. The axle 32 is inserted through the through hole 28 of the transmission member 20 into the tube portion 15 of the gear wheel 13 in a way that each of the protrusion blocks 35 is engaged with one of the engagement portions 25. As a result, the stirring shaft 30 can be driven by the transmission member 20 to rotate along with the transmission member 20. The stirring shaft 30 has a plurality of blades 37. When the stirring shaft 30 rotates, the blades 37 stir the stored waste toners in the waste toner container 1 so as to distribute the stored waste toners evenly in the waste toner container 1.

Figure 6A:
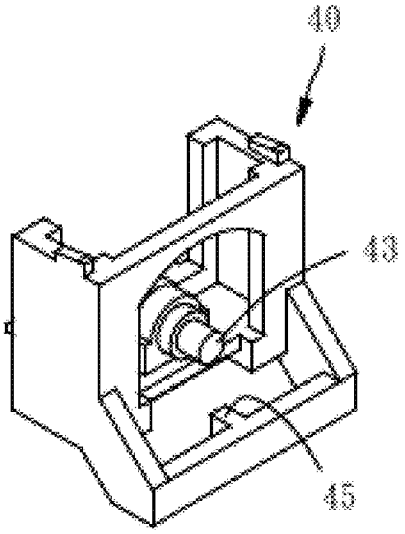
FIG. 6A is a perspective view of a fixation base of the waste toner detection device of the preferred embodiment of the present invention.
Figure 6B:
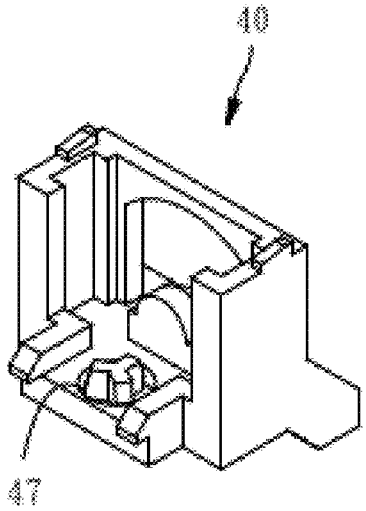
FIG. 6B is another perspective view of the fixation base of the waste toner detection device of the preferred embodiment of the present invention.

The fixation base 40 is disposed to the lateral cover 6. As shown in FIGS. 6A and 6B, the fixation base 40 includes a pivot 43 extending in a direction parallel to the imaginary axis L, a first hook portion 45 and a first limit groove 47.

Figure 7:
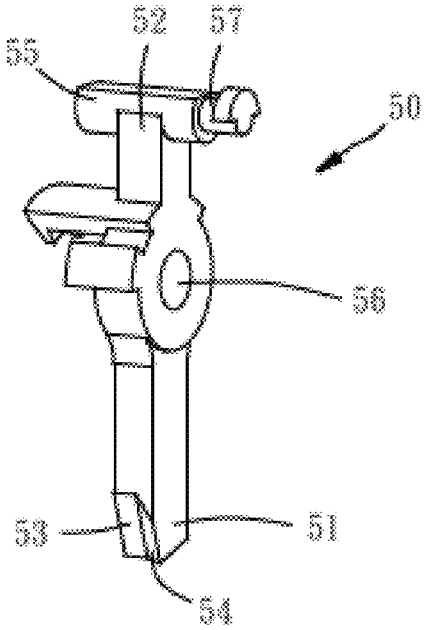
FIG. 7 is a perspective view of a rotary arm of the waste toner detection device of the preferred embodiment of the present invention.

The rotary arm 50 is rotatably disposed to the fixation base 40. As shown in FIG. 7, the rotary arm 50 includes a first end 51, a second end 52 opposite to the first end 51, an abutment portion 53 provided at the first end 51, a limit rod 55 extending from the second end 52 toward the indication member 60, a pivotal portion 56 between the first end 51 and the second end 52, and a second hook portion 57 extending from the second end in a direction away from the indication member 60. The abutment portion 53 has a second inclined hook surface 54 hookable with the first inclined hook surface 23. The pivotal portion 56 is pivotally connected with the pivot 43 of the fixation base 40, such that the rotary arm 50 can rotate about the pivot 43 when the abutment portion 53 is pushed by the push portion 22 of the transmission member 20.

Figure 10C:
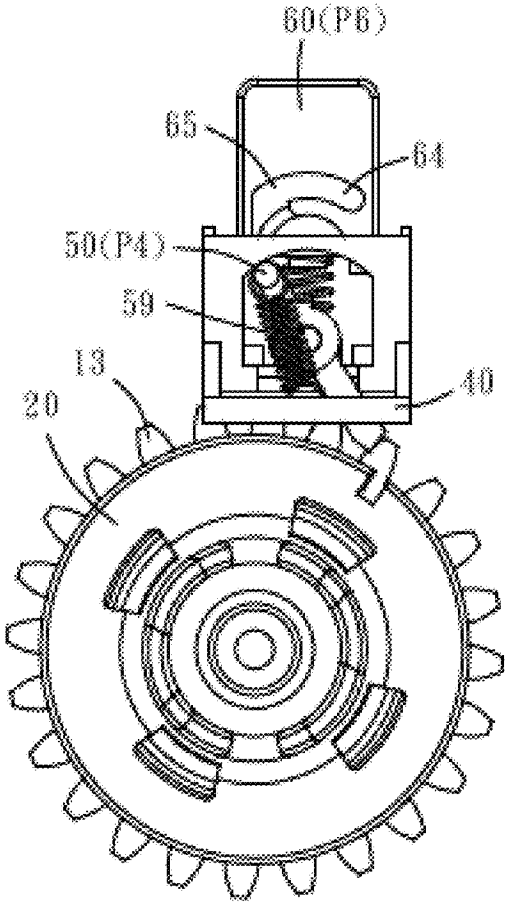
FIGS. 10A to 10C are schematic views showing various movements of the waster toner detection device of the preferred embodiment of the present invention.
Figure 10B:
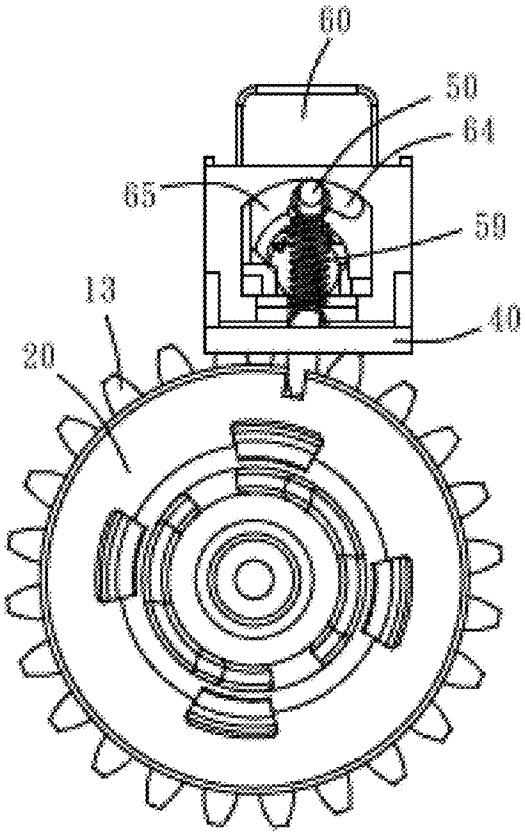
Figure 10A:
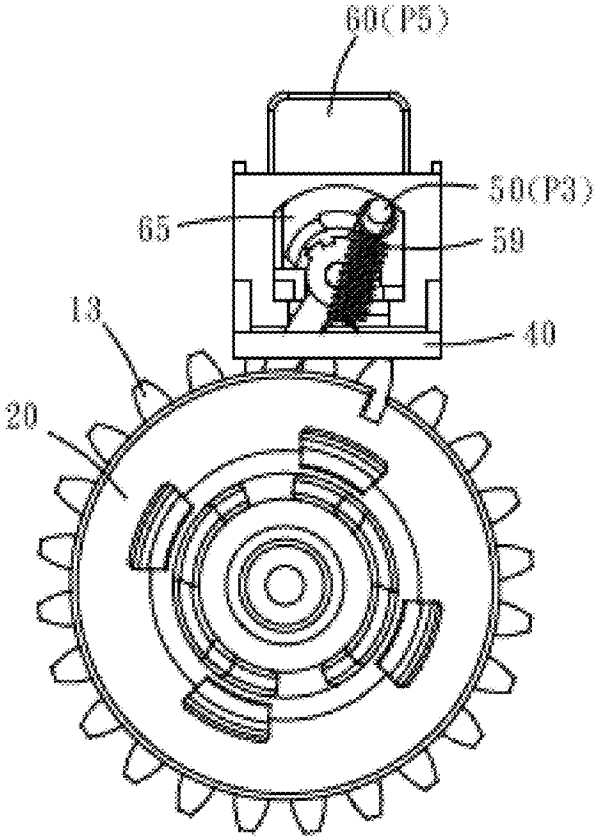

The second resilient member 59 is realized in this embodiment as a tension spring having two ends fixed to the first hook portion 45 and the second hook portion 57, respectively. As such, the second resilient member 59 imparts a biasing force exerting on the rotary arm 50 to force the second end 52 toward the imaginary axis L. That is, the second resilient member 59 imparts a biasing force on the rotary arm 50 to maintain the rotary arm 50 at a locked position P3, as shown in FIG. 10A, or a released position P4, as shown in FIG. 10C.

Figure 8B:
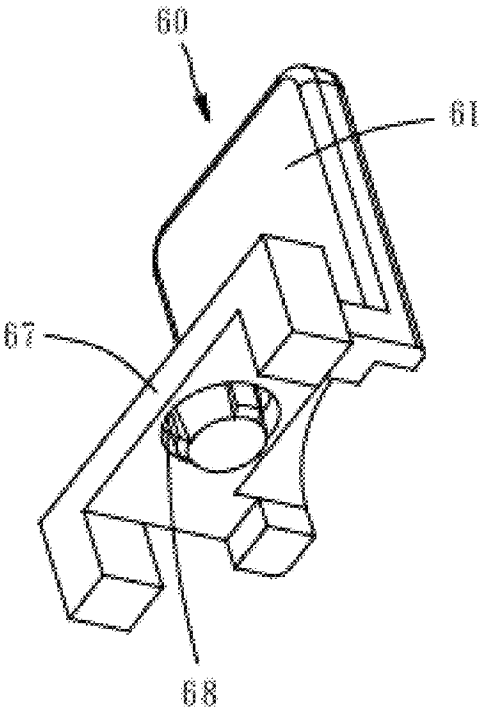
FIG. 8B is another perspective view of the indication member of the waste toner detection device of the preferred embodiment of the present invention.
Figure 8A:
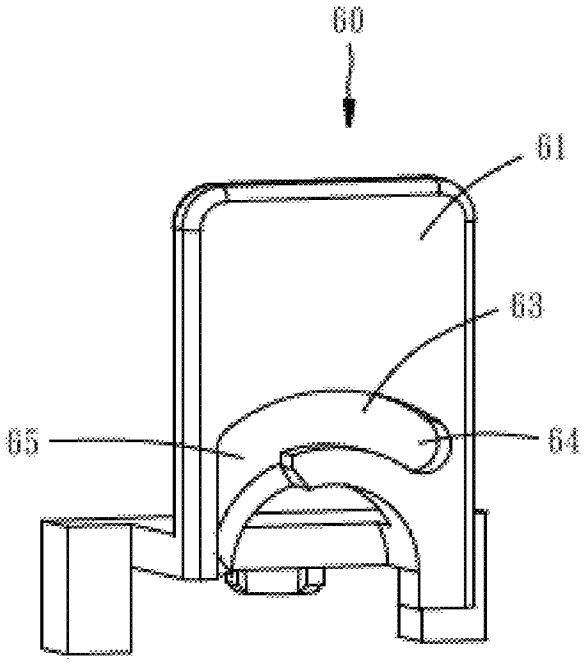
FIG. 8A is a perspective view of an indication member of the waste toner detection device of the preferred embodiment of the present invention.
Figure 11C:
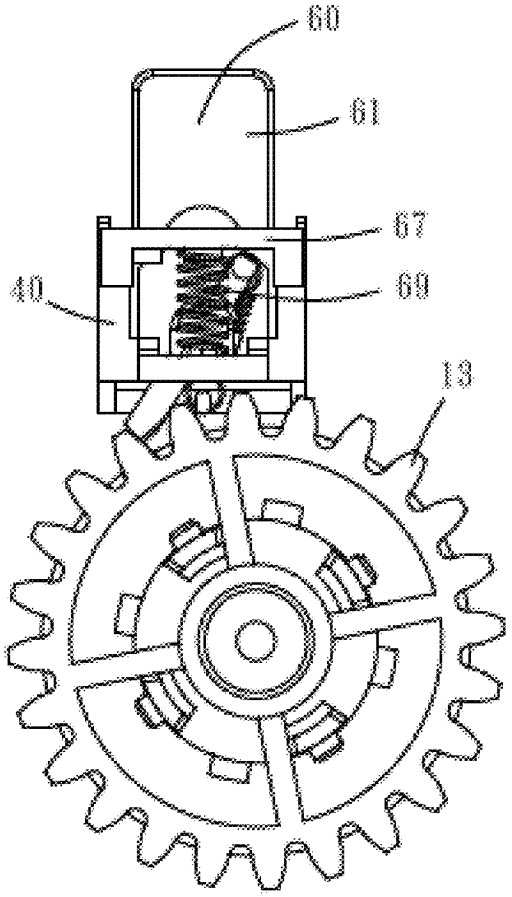
FIGS. 11A to 11C are schematic views corresponding to FIGS. 10A to 10C respectively, but viewed in a different viewing angle.
Figure 11B:
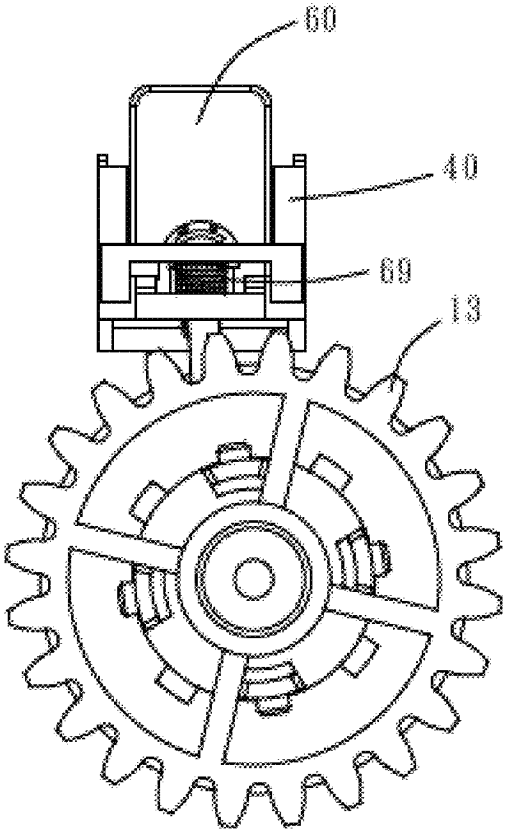
Figure 11A:
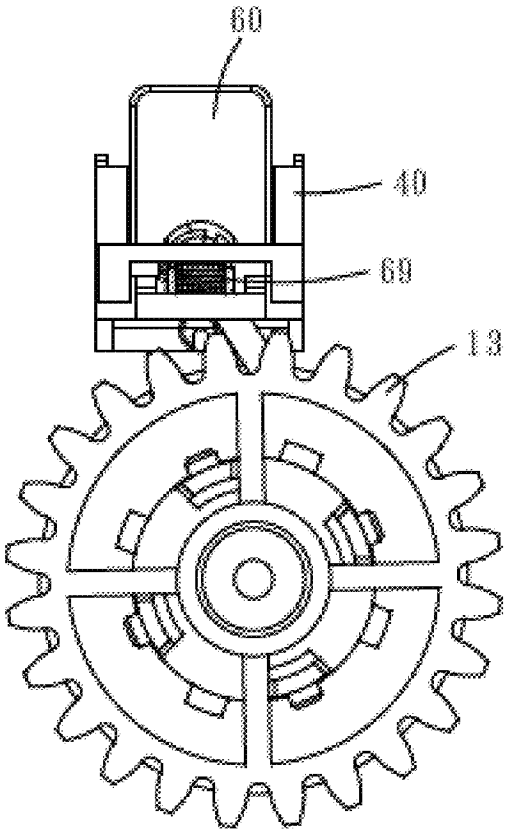

The indication member 60 is moveably mounted to the fixation base 40. The indication member 60 is drivenable by a biasing force to move from a retracted position P5, as shown in FIGS. 10A and 11A, to an extended position P6, as shown in FIGS. 10C and 11C. Further, as shown in FIGS. 8A and 8B, the indication member 60 includes a stop plate 61, an arc groove 63 at a side of the stop plate 61 that is adjacent to the rotary arm 50, a base portion 67 extending outwardly from the bottom portion of the stop plate 61, and a second limit groove 68 provided at the bottom surface of the base portion 67. The arc groove 63 has a closed end 64 and an open end 65. The limit rod 55 of the rotary arm 50 is inserted through the arc groove 63. The second limit groove 68 is spacedly in alignment with the first limit groove 47 of the fixation base 40. When the indication member 60 is moved from the retracted position P5 to the extended position P6, the indication member 60 is moved away from the imaginary axis L, i.e. the axial direction of the stirring shaft 30.

The third resilient member 69 is realized in this embodiment as a compression spring having two ends extended into and positioned at the first limit groove 47 of the fixation base 40 and the second limit groove 68 of the indication member 60, respectively. As such, the third resilient member 69 imparts a biasing force on the indication member 60 to move away from the imaginary axis L. That is, the third resilient member 69 imparts a biasing force exerting on the indication member 60 toward the extended position P6.

With the above mentioned structural design, at an initial status as shown in FIG. 9A, the transmission member 20 is located at the engaged position P1 away from the rotary arm 50 at a distance. By means of the engagement of the engagement portions 25 of the transmission member 20 with the protrusion blocks 35 of the connecting member 31 of the stirring shaft 30, the transmission member 20 transmits the rotational force of the gear wheel 13, i.e. transmits the rotational motion, to the stirring shaft 30, such that the stirring shaft 30 is driven by the transmission member 20 to rotate along with the transmission member 20. In this way, the blades 37 may stir the waste toners stored in the waste toner container 1 to distribute the waste toners evenly in the waste toner container 1. At this moment, the second resilient member 59 maintains the rotary arm 50 at the locked position P3, as shown in FIG. 10A, in a way that the limit rod 55 is located at the closed end 64 of the arc groove 63. Because the limit rod 55 is stopped against the lateral wall of the arc groove 63, the indication member 60, which though receives a biasing force of the third resilient member 69, cannot move in a direction away from the imaginary axis L. That is, the indication member 60 is restricted by the rotary arm 50 to stay at the retracted position P5, as shown in FIGS. 10A and 11A. With the increase of the amount of the waste toners stored in the waste toner container 1, the rotational resistance against the stirring shaft 30 increases, i.e. the rotational load of the stirring shaft 30 increases, resulting in that the protrusion blocks 35 of the connecting member 31 of the stirring shaft 30 and the engagement portions 25 of the transmission member 20 become gradually displaced from each other and the reacting force exerting on the transmission member 20 overcomes the biasing force of the first resilient member 29 to push the transmission member 20 to gradually move to the disengaged position P2.

As the amount of the waste toners contained in the waste toner container 1 reaches a predetermined level, i.e. the rotational resistance against the stirring shaft 30 reaches a threshold value, the transmission member 20 will be pushed to a position closest to the gear wheel 13. At this moment, the engagement portions 25 of the transmission member 20 are disengaged from the protrusion blocks 35 of the connecting member 31 of the stirring shaft 30, resulting in that the stirring shaft 30 is no longer rotatable with the transmission member 20 and the transmission member 20 is located at the disengaged position P2 adjacent to the rotary arm 50, as shown in FIG. 9B.

When the transmission member 20 is located at the disengaged position P2, the transmission member 20 is still rotated along with the gear wheel 13, such that the first inclined hook surface 23 of the push portion 22 will hook the second inclined hook surface 54 of the rotary arm 50, and with continual rotation of the transmission member 20, the transmission member 20 will push the first end 51 of the rotary arm 50 to move, resulting in that the rotary arm 50 rotates from the locked position P3 to the released position P4. During the rotational motion of the rotary arm 50, the limit rod 55 will move along the arc groove 63 to a position, which is shown in FIG. 10B, where the second resilient member 39 is stretched to the longest. When the rotary arm 50 continuously rotates to the released position P4, the limit rod 55 rotates to the open end 65 and then escapes from the arc groove 63. At the same time, the second resilient member 59 imparts a biasing force exerting on the rotary arm 50 to hold the rotary arm 50 at the released position P4, as shown in FIG. 10C. Further, the indication member 60, which is no longer restricted by the rotary arm 50, will be driven by the biasing force of the third resilient member 69 to move from the retracted position P5 to the extended position P6 in a way that the base portion 67 is stopped against an inner wall of the lateral cover 6. As a result, the indication member 60 is restricted by the lateral cover 6 to stay at the extended position P6. As shown in FIG. 11C, when the indication member 60 is located at the extended position P6, the stop plate 61 will be detected by the sensor to enable the electronic image-forming apparatus to announce a warning signal indicative of a sign that the waste toner container 1 needs to be replaced.

With the above-disclosed structural features, when the amount of the waste toners contained in the waster toner container 1 reaches a predetermined level, the indication member 60 of the waste toner detection device 10 will protrude over the lateral cover 6 via the opening 7 and then be detected by the sensor of the electronic image-forming apparatus, as shown in FIGS. 1 and 3. As such, whether the amount of the waste toners stored in the waster toner contain has reached a predetermined level can be accurately detected, thereby achieving the objective of the present invention.

It will be appreciated that the sensor of the electronic image-forming apparatus, the connecting way between the transmission member 20 and the stirring shaft 30, the engagement structure between the rotary arm 50 and the indication member 60, and the structures of and connecting way between the gear wheel 13 and the transmission member 20 are not limited to the disclosures in this embodiment, and may be modified and varied in many ways.

Based on the above-mentioned technical features, various modifications to the structure of the waste toner detection device 10 may be made. For example, the fixation base 40 and the lateral cover 6 may be monolithically made as one unitary member or may be made with other modifications. Further, the first inclined hook surface 23 and the second inclined hook surface 54 may be omitted as long as the transmission member 20 can push the arm 50 to rotate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A waste toner detection device, comprising:

a stirring shaft for stirring waste toners;

a transmission member, which is moveable in response to a rotational load of the stirring shaft along an axial direction of the stirring shaft between an engaged position and a disengaged position in a way that the transmission member transmits a rotational motion to the stirring shaft when the transmission member is located at the engaged position, and the transmission member does not transmit the rotational motion to the stirring shaft when the transmission member is located at the disengaged position, the transmission member having a push portion;

a rotary arm driven by the push portion of the transmission member to rotate from a locked position to a released position when the transmission member is located at the disengaged position; and an indication member moveable by a biasing force from a retracted position to an extended position in a way that the indication member is restricted by the rotary arm to maintain at the retracted position when the rotary arm is located at the locked position, and the indication member is driven by the biasing force to move from the retracted position to the extended position without being restricted by the rotary arm when the rotary arm is located at the released position.

2. The waste toner detection device as claimed in claim 1, wherein the transmission member comprises a disc body; the push portion of the transmission member extends from the disc body.

3. The waste toner detection device as claimed in claim 2, wherein the disc body of the transmission member comprises an engagement portion extending toward the stirring shaft; the stirring shaft is disposed at an end thereof with a connecting member; when the transmission member is located at the engaged position, the engagement portion of the disc body is engaged with the connecting member of the stirring shaft such that the transmission member and the stirring shaft rotate synchronously; when the transmission member is located at the disengaged position, the engagement portion of the disc body is disengaged from the connecting member of the stirring shaft such that the stirring shaft does not rotate along with the transmission member.

4. The waste toner detection device as claimed in claim 1, further comprising a first resilient member imparting a biasing force on the transmission member toward the engaged position.

5. The waste toner detection device as claimed in claim 4, further comprising a gear wheel rotated with the transmission member; the first resilient member is disposed between the gear wheel and the transmission member.

6. The waste toner detection device as claimed in claim 1, further comprising a second resilient member imparting a biasing force on the rotary arm to maintain the rotary arm at the locked position or the released position.

7. The waste toner detection device as claimed in claim 6, further comprising a fixation base; the rotary arm is rotatably disposed on the fixation base; the indication member is moveably disposed on the fixation base; the second resilient member is disposed between the fixation base and the rotary arm.

8. The waste toner detection device as claimed in claim 1, wherein the rotary arm is provided at a first end thereof with an abutment portion pushable by the push portion of the transmission member to enable that the rotary arm is driven by the push portion of the transmission member to rotate from the locked position to the released position.

9. The waste toner detection device as claimed in claim 8, wherein the rotary arm is provided at a second end thereof with a limit rod; the indication member is provided with an arc groove into which the limit rod extends; the arc groove of the indication member has an closed end and an open end; when the rotary arm is located at the locked position, the limit rod is located at the closed end of the arc groove; when the rotary arm is located at the released position, the limit rod escapes from the arc groove via the open end of the arc groove.

10. The waste toner detection device as claimed in claim 8, wherein the push portion of the transmission member comprises a first inclined hook surface; the abutment portion of the rotary arm comprises a second inclined hook surface hookable with the first inclined hook surface.

11. The waste toner detection device as claimed in claim 1, further comprising a third resilient member imparting the biasing force on the indication member toward the extended position.

12. The waste toner detection device as claimed in claim 11, further comprising a fixation base; the rotary arm is rotatably disposed on the fixation base; the indication member is moveably disposed on the fixation base; the third resilient member is disposed between the fixation base and the indication member.

13. The waste toner detection device as claimed in claim 1, wherein when the indication member moves from the retracted position to the extended position, the indication member moves away from the axial direction of the stirring shaft.

14. The waste toner detection device as claimed in claim 1, further comprising a fixation base; the rotary arm is rotatably disposed on the fixation base; the indication member is moveably disposed on the fixation base.

* * * * *